US008342459B2

(12) United States Patent
Garrison et al.

(10) Patent No.: US 8,342,459 B2
(45) Date of Patent: Jan. 1, 2013

(54) WIRE ORGANIZER

(75) Inventors: David M. Garrison, Longmont, CO (US); Jeffrey Townsend, Loveland, CO (US)

(73) Assignee: Covidien LP, Mansfield, MA (US)

( * ) Notice: Subject to any disclaimer, the term of this patent is extended or adjusted under 35 U.S.C. 154(b) by 905 days.

(21) Appl. No.: 12/395,812

(22) Filed: Mar. 2, 2009

(65) Prior Publication Data

US 2009/0223041 A1 Sep. 10, 2009

Related U.S. Application Data

(60) Provisional application No. 61/034,218, filed on Mar. 6, 2008.

(51) Int. Cl.
*H01R 9/00* (2006.01)

(52) U.S. Cl. ..... 248/68.1; 248/74.2; 248/74.3; 248/316.7

(58) Field of Classification Search ..... 29/755; 248/68.1, 74.2, 74.3, 316.7; 174/72 A, 101, 174/95, 500, 68.1, 68.3; 52/220.7, 220.1; 385/135

See application file for complete search history.

(56) References Cited

U.S. PATENT DOCUMENTS 3,588,081 A * 6/1971 Logan et al. ..... 69/40
3,693,228 A * 9/1972 Logan ..... 29/56.6
3,842,496 A * 10/1974 Mercer ..... 29/867
3,949,457 A * 4/1976 Fortsch ..... 29/755
4,244,544 A * 1/1981 Kornat ..... 248/68.1
4,262,985 A 4/1981 Muelhlhausen II
4,424,403 A * 1/1984 Bogese, II ..... 174/36
4,453,798 A * 6/1984 Asick et al. ..... 439/581
4,476,628 A * 10/1984 Kees, Jr. ..... 29/861
4,601,530 A 7/1986 Coldren et al.
4,646,433 A * 3/1987 Le Houerou et al. ..... 29/755
4,729,531 A * 3/1988 Smith et al. ..... 248/68.1
4,797,112 A 1/1989 Weisenburger
5,147,215 A 9/1992 Pritulsky
5,363,539 A * 11/1994 Tisol ..... 24/543
5,655,284 A * 8/1997 Ferrill et al. ..... 29/566.3
5,915,980 A * 6/1999 Baldock ..... 439/120
5,944,552 A 8/1999 Hanami
6,083,039 A 7/2000 Finona
6,099,345 A 8/2000 Milner et al.
6,184,474 B1 * 2/2001 Craft, Jr. ..... 174/135
6,227,502 B1 * 5/2001 Derman ..... 248/74.4
6,250,951 B1 6/2001 Milner et al.
6,268,566 B1 7/2001 Takiguchi et al.
6,290,532 B1 9/2001 Vermeersch et al.
6,783,100 B1 * 8/2004 Cinq-Mars ..... 248/49
6,976,512 B2 12/2005 Loeffler et al.
7,160,147 B1 * 1/2007 Stephan ..... 439/535
7,232,953 B2 * 6/2007 Torii et al. ..... 174/74 R
7,712,709 B2 * 5/2010 Winchester ..... 248/89
D640,527 S * 6/2011 Hoek ..... D8/356
7,954,287 B2 * 6/2011 Bravo et al. ..... 52/220.1
D657,869 S * 4/2012 Mammen ..... D24/128
2003/0196320 A1 * 10/2003 Ikeda et al. ..... 29/749
2005/0229390 A1 * 10/2005 Romagnoli et al. ..... 29/748
2010/0132979 A1 * 6/2010 Chen ..... 174/135

* cited by examiner

*Primary Examiner* — Derris Banks
*Assistant Examiner* — Kaying Kue

(57) ABSTRACT

A wire organizer is disclosed for organizing and restraining individual wires. The wire organizer includes a wire comb capable of transitioning individual wires from a radial arrangement to a side-by-side arrangement for connection to a series of electrical contacts arranged in a closely spaced relation. A cable cuff is also included and is capable of restraining individual wires against a jacket of the cable. The wire comb and cable cuff may each be loaded axially or longitudinally and may be coupled to one another by a bridge.

10 Claims, 7 Drawing Sheets

WIRE ORGANIZER

CROSS-REFERENCE TO RELATED APPLICATIONS

This application claims the benefit of priority to U.S. Provisional Application Ser. No. 61/034,218 entitled "WIRE ORGANIZER" filed Mar. 6, 2008 by David M. Garrison et al, which is incorporated by reference herein.

BACKGROUND

1. Technical Field

The present disclosure relates generally to a wire organizer for separating and restraining wires routed through an electronic device. In particular, the present disclosure relates to a wire organizer adapted to permit pre-positioning of discrete wires for use in an over-molded electrical junction assembly.

2. Background of Related Art

Wiring for electronic devices such as instruments found in the surgical arts requires organization, for example, to promote efficient manufacturing and maintenance. The various electronic components found in these instruments include circuit boards and power connectors that often involve many discrete and closely spaced contacts facilitating electrical communication with other components. A component may receive inputs at these contacts through wires routed from any number of sources and similarly provide outputs to any number of destinations. When several wires are required to be routed through an instrument along a similar path, an electrical cable is often used to maintain a grouping of the wires.

An electrical cable typically consists of a core of discrete wires and a dielectric sheath or jacket covering and protecting the core. Each discrete wire includes a conductor for transmitting an electrical potential and may also include an insulation layer for electrically isolating the conductor from other conductors in the cable. In a round cable, the discrete wires may be arranged in a radial pattern such that the cable takes on a circular cross section. In contrast, conductors in a flat cable or flexible circuit are often arranged in a side-by-side relationship. It is often necessary to connect the conductors in a round cable to contacts arranged in a side-by-side relationship. Also, it is often convenient to complete such a connection at a point in the manufacturing process well after the cable and flexible circuit are assembled.

One such instance is in the manufacturing of a surgical instrument such as the endoscopic forceps described in U.S. patent application Ser. No. 11/540,335 by Patrick L. Dumbauld. In this particular application, several discrete signal wires emerging from the dielectric sheath of a round cable are electrically coupled to side-by-side solder terminals extending from a flexible circuit. One solder terminal is reserved for connection to a wire more conveniently routed outside the cable, while several power wires routed inside the cable must be re-directed away from the solder terminals almost immediately after exiting the dielectric sheath. In this relatively complex environment for an electrical junction, several process failures may occur. These include wire pinching, crushing, partial wire encapsulation, and leak path creation through an over-mold intended to protect the connection.

SUMMARY

The present disclosure describes an electrical wire organizer for facilitating the connection of discrete wires in an electrical cable to a series of electrical contacts arranged in a closely spaced relation to one another. The wire organizer may include one or both of a cable cuff for restraining the cable, and a wire comb having wire receiving channels open to opposite faces. Each wire receiving channel is dimensioned to accept a wire and form friction fit with an insulation layer thereof. At least one of the wire receiving channels may be enlarged to accept a larger gauge wire than the others. Each of the wire receiving channels may be open to a peripheral side of the wire comb to allow a wire to be pressed laterally into place. A reduced width portion may be included in such a wire receiving channel to restrain the wire once it is pressed into place and tapered entry surfaces may ease the insertion of the wires.

The cable cuff may include a cable reception cavity and a wire reception cavity such that the cable cuff may restrain wires against the jacket of a cable. The cable cuff may be pressed laterally onto a cable and may be held in place by a friction fit with the cable jacket.

In one embodiment, the wire organizer includes a cable cuff and a wire comb coupled to one another by a bridge establishing an axial separation between the two components. In such a one-piece embodiment, a friction fit with only one of the wire comb and cable cuff may secure the axial position of the wire organizer. Such a wire organizer may include a cable cuff having a wire reception cavity, and may include also be pressed laterally onto the cable.

According to another aspect of the disclosure, a wire organizer may be included in an electrical junction assembly. Such an assembly may include a cable having discrete wires emerging from a jacket thereof, a series of electrical contacts coupled to the wires and an over-mold substantially surrounding both the series of electrical contacts and the wire organizer. The wire organizer may be coupled to the cable by a cable cuff, and coupled to the discrete wires by a wire comb that is coupled to the cable cuff by a bridge. The electrical contacts may comprise solder terminals in electrical communication with conductive traces contained on a flexible film. The over-mold may comprise a heat-shrinkable material.

Also, a method of coupling wires to a series of electrical contacts is described. The method involves loading the free ends of the wires into wire receiving channels on a wire organizer, connecting each wire to an electrical contact and applying an over-mold to substantially surround the series of electrical contacts and wire organizer. The loading of the individual wires may be accomplished by clipping the wire organizer laterally onto the free ends of the wires.

BRIEF DESCRIPTION OF THE DRAWINGS

The accompanying drawings, which are incorporated in and constitute a part of this specification, illustrate embodiments of the present disclosure and, together with the detailed description of the embodiments given below, serve-to explain the principles of the disclosure.

DETAILED DESCRIPTION

Figure 1:
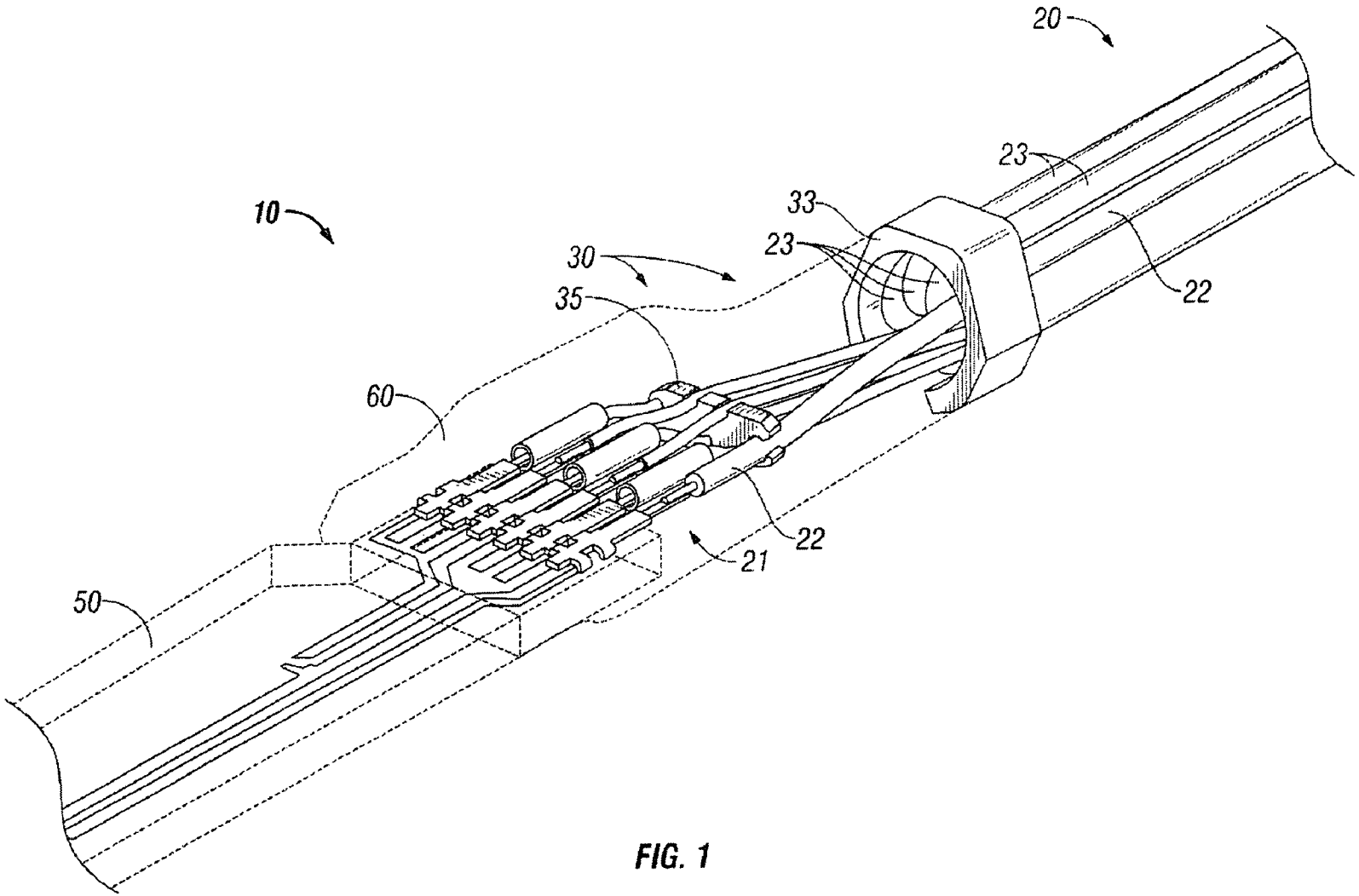
FIG. 1 is a perspective view of an electrical junction assembly according to one embodiment of the present disclosure.

The attached figures illustrate embodiments of the present disclosure and are referenced to describe the embodiments depicted therein. Hereinafter, the disclosure will be described in detail by explaining the figures wherein like reference numerals represent like parts throughout the several views.

Referring initially to FIG. 1, electrical junction assembly 10 includes a wire organizer 30 facilitating the connection of wires 21 to flexible circuit 50. As described in greater detail below, wires 21 include an individual wire 22 and five discrete signal wires 24 (FIG. 2) emerging from cable 20. Wire organizer 30 includes a wire comb 35, which separates wires 21, and an optional cable cuff or clip 33, which may be coupled to cable 20 thereby securing individual wire 22 and redirected power wires 23 thereto. Cable 20 and individual wire 22 are mechanically and electrically coupled to flexible circuit 50 as described in detail below. To protect this connection, over-mold 60 is formed by laminating or otherwise coating the electrical junction assembly 10 with a polymer, such as polyester, vinyl or other suitable material. In the case of a heat-shrinkable over-mold 60, a sleeve of a heat-shrinkable material may be positioned over all or any portion of electrical junction assembly 10. Heat applied to the over-mold 60 may then tend to cause the heat-shrinkable material to shrink in the radial direction, thereby forming a secure and effective environmental seal about the components contained within over-mold 60.

Figure 2:
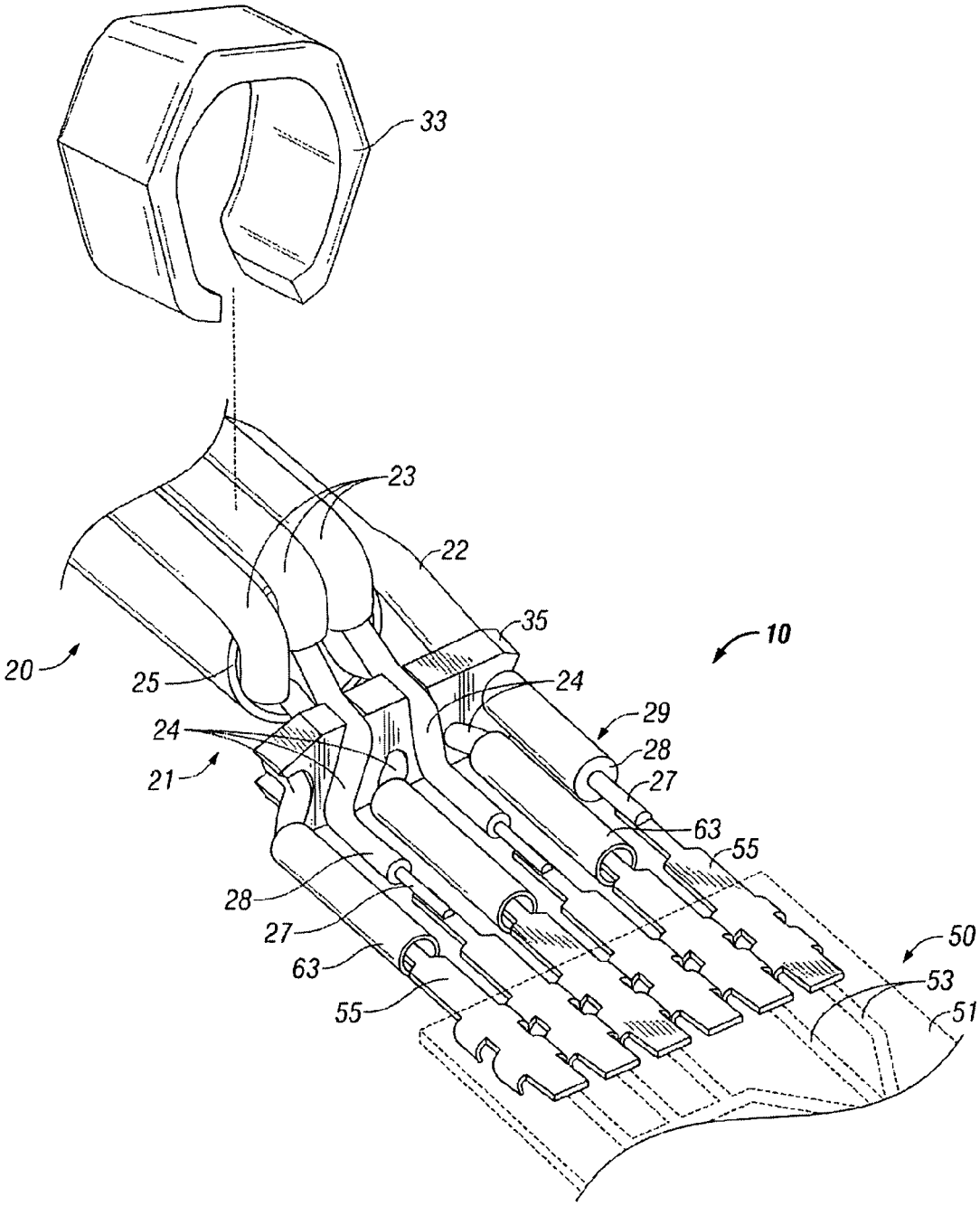
FIG. 2 is an enlarged perspective view of the electrical connection assembly of FIG. 1 shown without the over-mold and with a cable cuff separated for clarity.

Referring now to FIG. 2, electrical junction 10 is depicted with over-mold 60 removed and cable cuff 33 separated for clarity. Cable 20 defines an axial direction generally in line with the cable jacket 25 and a generally perpendicular lateral direction. As shown, eight discrete wires emerge axially from cable jacket 25 and each is routed to transmit an electrical potential between two particular locations within the electrical device. Five of the discrete wires are signal wires 24, and three are power wires 23. Signal wires 24 are adapted for transmitting signals of relatively low power such as data and information, while power wires 23 are adapted to have adequate mass and surface area to dissipate the heat associated with electrical power transmission. Therefore, power wires 23 may be a larger gauge than signal wires 24.

The three power wires 23 reverse direction almost immediately after exiting jacket 25. This abrupt redirection may give power wires 23 a tendency to pull away from the cable jacket 25, which could compromise the integrity of the environmental seal created by over-mold 60 (FIG. 1). Cable cuff 33 is adapted to restrain the power wires 23 against the exterior surface of the jacket 25. Individual wire 22 is also restrained against the jacket adjacent the power wires 23. Individual wire 22 connects at an opposite end (not shown) at a location distinct from the connection location of the opposite ends (not shown) of power wires 23. For this reason, individual wire 22 is not routed through cable jacket 25. Individual wire 22 may serve to transmit information similarly to signal wires 24, and individual wire 22 may be a larger gauge wire than signal wires 24.

The five signal wires 24 and individual wire 22 collectively form wires 21, which are connected to flexible circuit 50. Wires 21 are routed through wire comb 35 where they are transitioned from the generally radial arrangement of round cable 20 to the side-by-side arrangement and particular pitch of the row of solder terminals 55 of flexible circuit 50. This transition facilitates the connection of wires 21 at their free ends 29 to flexible circuit 50. The conductor 27 of each wire 21 may be electrically and mechanically coupled to solder terminals 55 by soldering or any other suitable means. The wire comb 35 serves to separate and restrain the wires 21 to facilitate the connection to the solder terminals 55, and thereafter adequate separation and spacing of the wires 21. The solder terminals 55 are each in electrical communication with a conductive trace 53 contained in a flexible film 51. Electrical insulators 63 may be positioned over alternating conductors 27 as shown to ensure each solder terminal 55 is electrically isolated from neighboring solder terminal 55. Electrical insulators 63 may comprise a suitably sized length of a heat-shrinkable material similar to the material which comprises over-mold 60 (FIG. 1).

Figure 3:
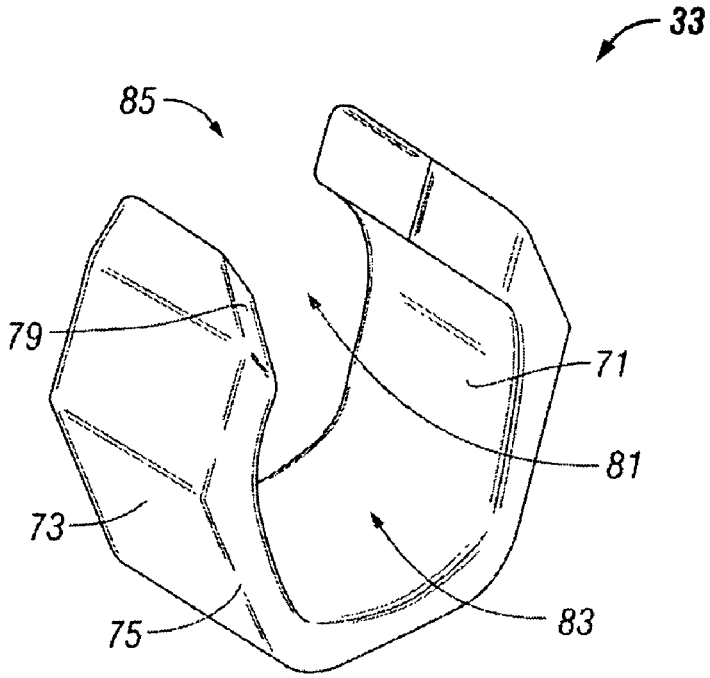
FIG. 3 is an enlarged perspective view of the cable cuff of FIG. 1.

Referring now to FIG. 3, the cable cuff 33 is described in detail. Cable cuff 33 has an interior surface 71 and an exterior surface 73. Open end 85 provides access to the interior and includes tapered entry surfaces 79 facilitating the lateral placement of cable cuff 33 onto cable 20. Alternatively, cable 20 may be inserted axially through cable reception cavity 81. Also on the interior of cable cuff 33, and opposite the open end 85 is free wire reception cavity 83 through which wires 22, 23 may be routed. In operation, cable 20 and wires 22, 23 are inserted into the cable cuff 33 such that cable 20 is situated between wires 22, 23 and open end 85 such that wires 22, 23 are retained. The cable cuff 33 may compress the cable jacket 25 and wire insulation 28 such that a friction fit is formed preventing the cable cuff 33 from moving axially along the cable 20. The exterior surface 73 of cable cuff 33 is generally rounded and filleted to facilitate handling and also to reduce the likelihood of sharp edges puncturing or tearing the over-mold 60. Also, rounded edges 75 are provided to prevent damage to the cable jacket 25 or wire insulation 28.

Figure 4:
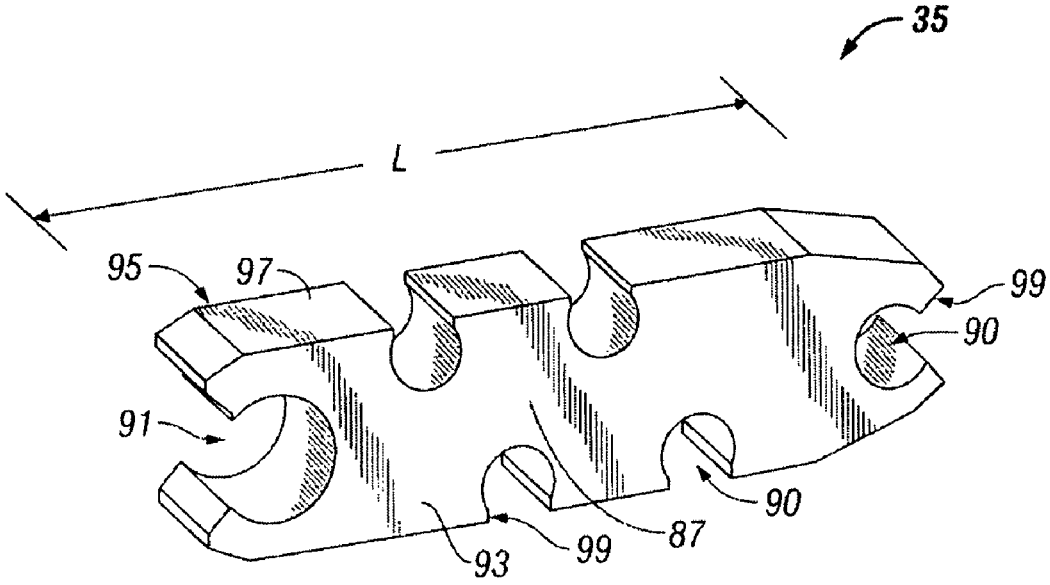
FIG. 4 is an enlarged perspective view of the wire comb of FIG. 1.

Referring now to FIG. 4, wire comb 35 is described in detail. Wire comb 35 includes a body 87 with a length L approximating the length of the row of solder terminals 55. The body 87 includes five wire receiving channels 90 adapted to accommodate the signal wires 24 and one enlarged wire receiving channel 91 adapted to accommodate the individual wire 22. Wire receiving channels 90, 91 are open to two opposite faces 93, 95 of the body 87 and are spaced along the length L of the body 87 to transition the wires 21 from the radial arrangement to the side-by-side arrangement and spacing of the solder terminals 55. As shown in FIG. 4, wire receiving channels 90, 91 may be arranged around the periphery of the body 87 such that multiple rows of wire receiving channels 90, 91 transition wires to a single row arrangement like the solder terminals 55. Wire receiving channels 90 may also be open to a peripheral side 97 of the body 87 so that a wire 24 may be inserted laterally. A reduced-width insertion portion 99 is included in each wire receiving channel 90 so that a wire 24, once inserted, tends to remain in place rather than escape through the open peripheral side 97. Also, wire receiving channels 90 may be configured to form a light friction fit with the insulation 28 of the discrete wires 21 to prevent any unintended axial movement of the discrete wires 21.

In operation, cable cuff 33 and wire comb 35 may be applied during the cable assembly process by feeding the free ends 29 of discrete wires 21 through the appropriate channels axially. The light friction lit will allow the wire organizer 30 to remain in place until such time the cable 20 is to be assembled with other components into the electrical device or instrument. With the wire organizer 30 in place, the free ends 29 of the discrete wires 21 may be coupled to the appropriate electrical contact, for example by soldering conductors 27 to solder terminals 55. Alternatively, the wire organizer 30 may be applied to the cable 20 and wires 21 after the free ends 29 have been coupled to their appropriate electrical contact by clipping the wire comb 35 and cable cuff 33 to the jacket 25 and insulation 28 laterally. Once in place, the wire organizer 30 maintains the proper position of the discrete wires 21 during and after the application of the over-mold 60.

Figure 5A:
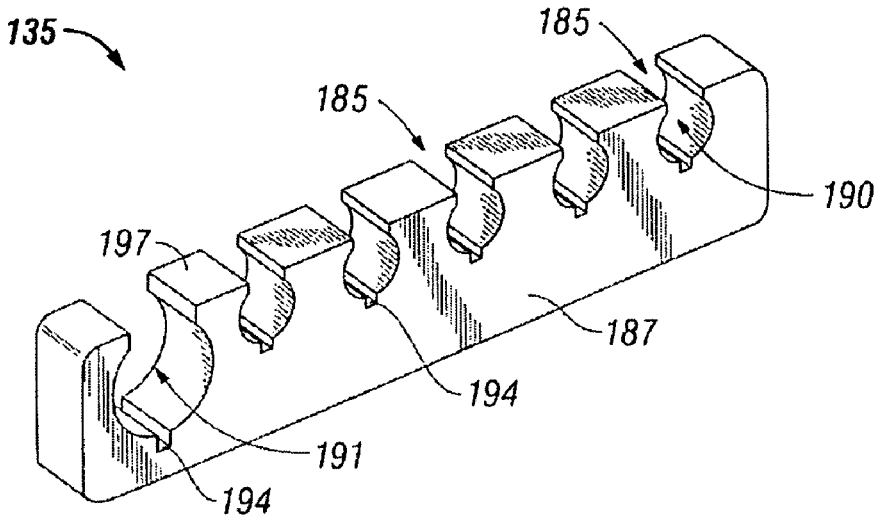
FIGS. 5A-5C are perspective views of alternative embodiments of a wire comb of the present disclosure.
Figure 5B:
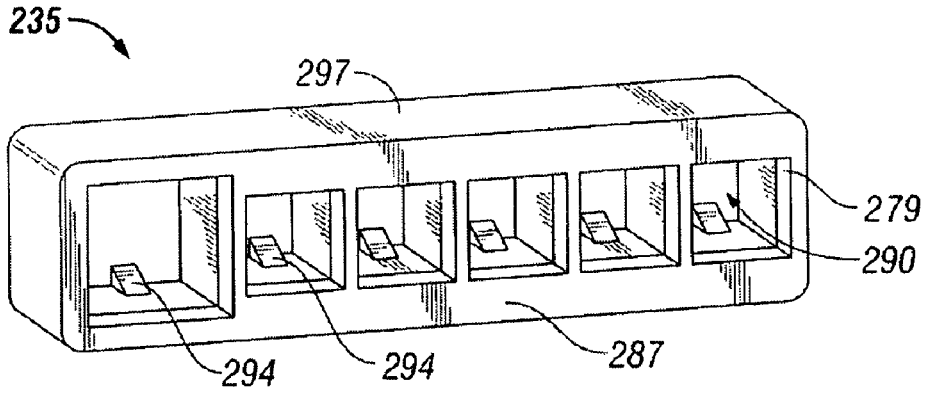
Figure 5C:
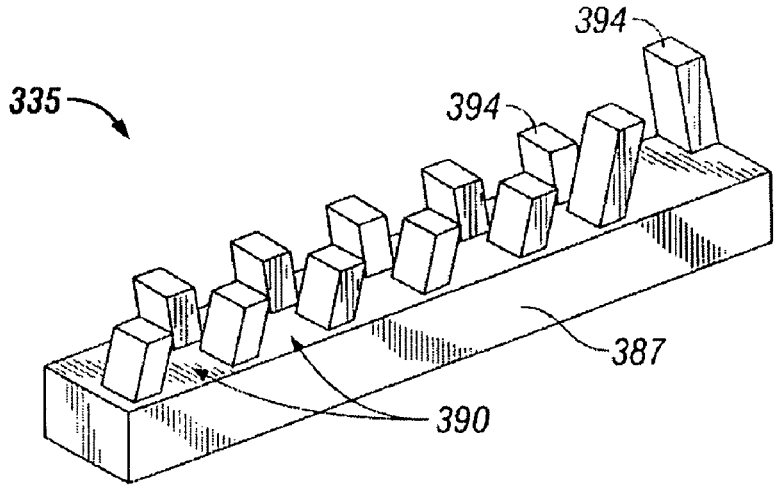

Referring next to FIGS. 5A through 5C, several alternate embodiments of a wire comb suitable for use with the present disclosure are presented. Wire comb 135 depicted in FIG. 5A features a single row of wire receiving channels 190 along a single peripheral side 197 of the body 187. In some instances where access to an electrical junction assembly is limited to one direction, this configuration can facilitate installation of the wire comb 135. Each wire receiving channel 190 includes a notch 194 opposite the open end 185 to allow the wire receiving channels 190 to flex slightly to facilitate the lateral insertion of a wire. An enlarged wire receiving channel 191 may be included for the introduction of larger gauge wires.

Wire comb 235 depicted in FIG. 5B features a row of wire receiving channels 290 with no end open on a peripheral side 297 of the body 287. Wires may be inserted axially through the wire receiving channels 290 and are thereafter positively restrained. A ramp 294 situated within each wire receiving channel 290 is configured prevent reverse axial movement of the wires by forming a light friction fit with the insulation of the wires. The configuration of wire comb 235 may be particularly useful, for example, in a low pressure molding process for application of a polymer such as over-mold 60 that subjects individual wires to forces tending to laterally displace wires from their position in wire comb 235. Tapered entry surfaces 279 facilitate the axial insertion of the individual wires in the direction appropriate for ramps 294 to wedge the wire into place by forming a friction fit with the insulation.

Wire comb 335 depicted in FIG. 5C features wire receiving channels 390 disposed between angled spokes 394 protruding from the body 387. This configuration enhances the ease of installation.

Figure 6A:
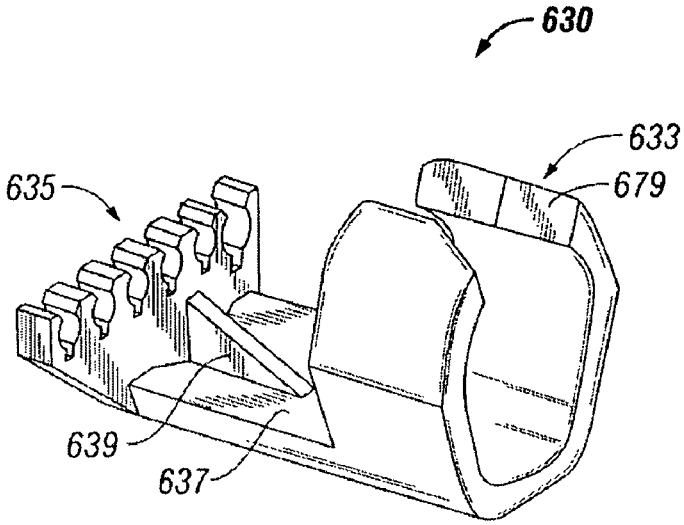
FIGS. 6A and 6B are perspective views a wire organizer of the present disclosure having a one-piece configuration.
Figure 6B:
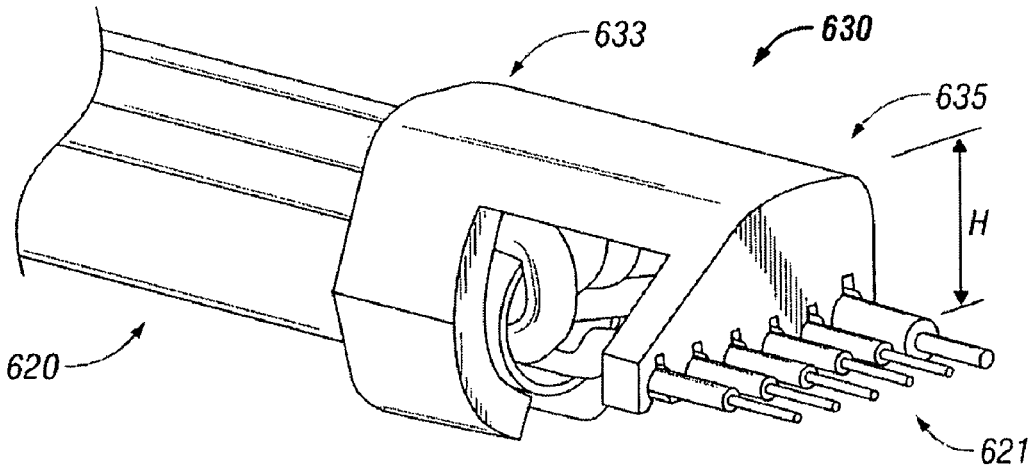

Next, referring to FIGS. 6A and 6B, a wire organizer 630 is described having a one-piece configuration with cable cuff 633 and wire comb 635 coupled by bridge 637. Bridge 637 maintains an axial spacing between the cable cuff 633 and the wire comb 635 and may also guide wires 621 into position by defining lateral offsets in any direction, for example, in the direction of height H. The embodiment shown is particularly adapted for installation by inserting cable 620 and wires 621 laterally into cable cuff 633 and wire comb 635. The cable cuff 633 includes tapered insertion surfaces 679 and wire comb 635 includes notches 694 as described above with reference to FIG. 5A. Also, bridge 637 is relatively wide and short having a support rib 639 to prevent the bridge 637 from breaking as wires 621 are pressed laterally into place.

Figure 7A:
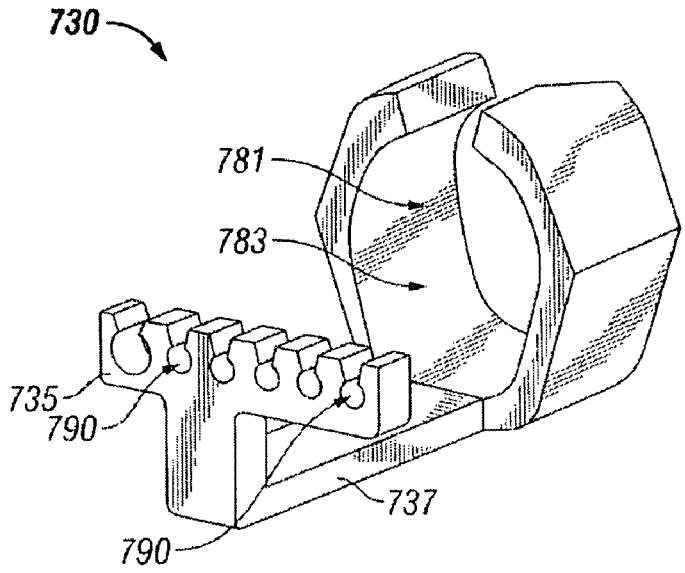
FIGS. 7A and 7B are perspective views of an alternate embodiment of a one-piece wire organizer, which permits some axial movement of wires through the cable cuff.
Figure 7B:
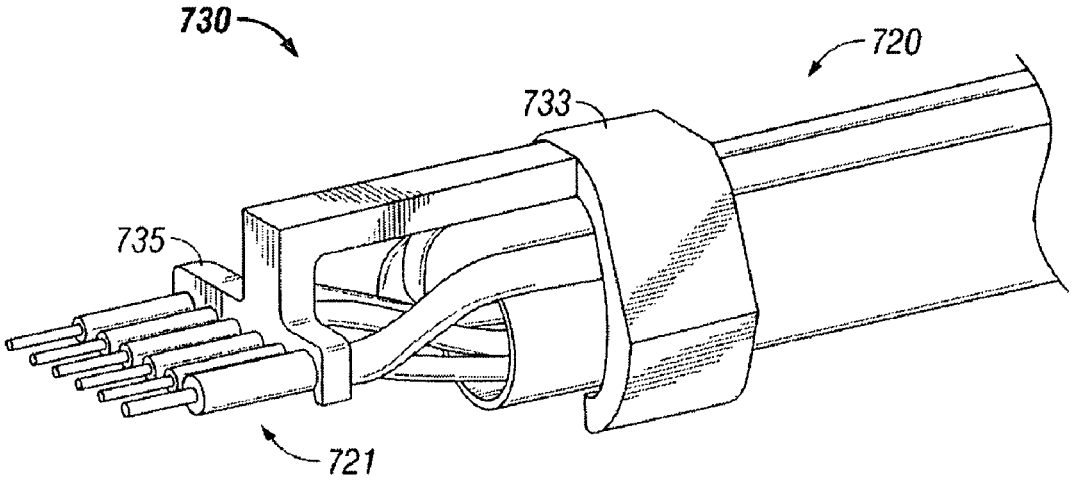

Referring now to FIGS. 7A and 7B, wire, organizer 730 may be better suited for axial installation of cable 720 and wires 721 having a longer and narrower bridge 737 coupling cable cuff 733 to wire comb 735. Also, cable reception cavity 781 and wire reception cavity 783 may be elongated to laterally capture cable 720 and wires 721, but permit free axial movement through the cable cuff 733, thus facilitating an axial installation. A friction fit may be formed only between wires 721 and wire receiving channels 790 of wire comb 735 to secure the axial position wire organizer 730. A friction fit is thus not necessary on both components of the wire organizer 730.

Figure 8A:
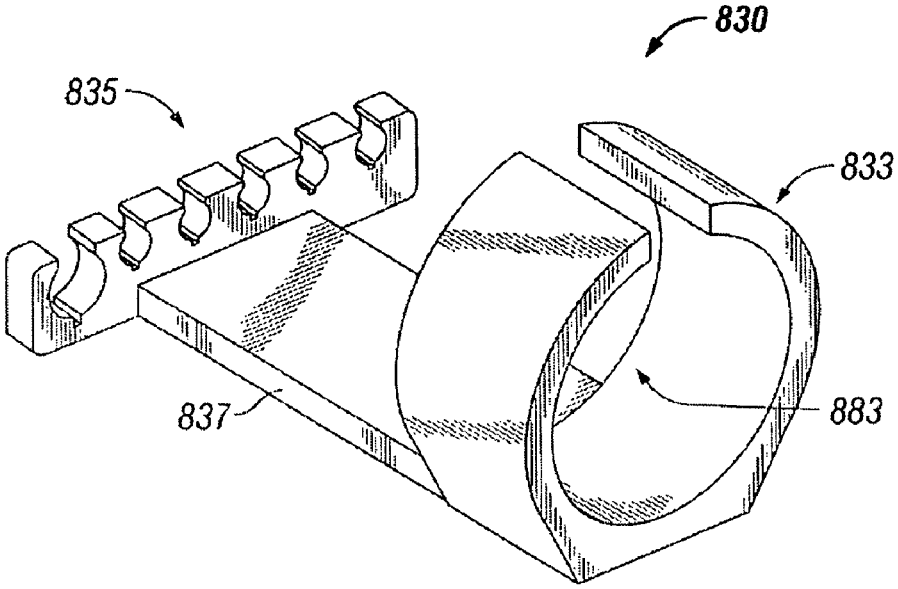
FIGS. 8A and 8B are perspective views of an alternate embodiment of a one-piece wire organizer without a free wire reception cavity.
Figure 8B:
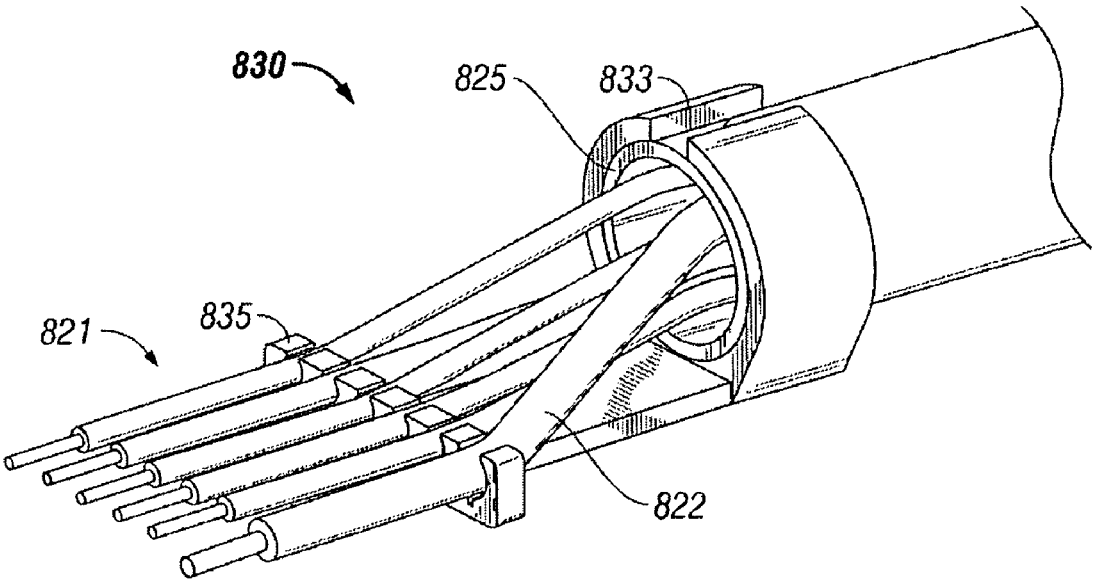

Referring next to FIGS. 8A and 8B, a one-piece wire organizer 830 is depicted with a bridge 837 coupling wire comb 835 to cable cuff 833. Cable cuff 833 includes a substantially round cable reception cavity 883 with no cavity to accommodate individual wires. This demonstrates how a wire organizer 830 may be adapted for alternate cable constructions and wire routing schemes. For example, as shown in FIG. 8B, wire 822 may be routed inside the cable jacket 825 such that wire organizer 830 only accommodates wires 821 emerging from cable jacket 825.

Although the foregoing disclosure has been described in some detail by way of illustration and example, for purposes of clarity or understanding, certain changes and modifications may be practiced within the scope of the appended claims.

What is claimed is:

1. An electrical wire organizer for facilitating the connection of a plurality of wires disposed within an electrical cable to a series of discrete electrical contacts arranged in a closely spaced relation comprising:

a cable-receiving cuff configured to frictionally secure the electrical cable; and a wire comb having a plurality of wire receiving channels defined therein, the wire receiving channels configured to position respective ones of the plurality of wires relative to a corresponding electrical contact and each wire receiving channel including an opening through a peripheral side such that a respective wire may be pressed laterally through the opening and wherein each opening is configured with a reduced width with respect to a portion of the corresponding wire receiving channel that is more distant from the peripheral side than the opening, at least one of the plurality of wire receiving channels configured to form a friction fit with an insulating portion of one of the plurality of wires when such wire is inserted therethrough, and wherein each of the wire receiving channels includes a notch opposite the opening to facilitate flexing of the wire receiving channel.

2. The wire organizer according to claim 1, wherein at least a respective one of the wire receiving channels is configured to accommodate a larger gauge wire than another one of the wire receiving channels.

3. The wire organizer according to claim 1, wherein each opening is configured with tapered entry surfaces.

4. The wire organizer according to claim 1, wherein the cable-receiving cuff includes a cable reception cavity and a wire reception cavity on an interior portion thereof, the cable reception cavity configured to couple the cable-receiving cuff to a jacket of a cable and the wire reception cavity configured to restrain at least one individual wire against the cable jacket.

5. The wire organizer according to claim 4, wherein the cable-receiving cuff further comprises an open end to facilitate a lateral insertion of the cable.

6. The wire organizer according to claim 1, further comprising a bridge coupling the cable-receiving cuff to the wire comb defining an axial separation therebetween.

7. The wire organizer according to claim 6, wherein the cable-receiving cuff includes a cable reception cavity and a wire reception cavity on an interior portion thereof, the cable reception cavity configured to couple the cable-receiving cuff to a jacket of a cable and the wire reception cavity configured to restrain at least one individual wire against the cable jacket.

8. The wire organizer according to claim 7, wherein the cable-receiving cuff includes an open end, the cable reception cavity disposed between the wire reception cavity and the open end.

9. The wire organizer according to claim 1, wherein each of the wire receiving channels includes a ramp therein having an incline in an axial direction.

10. The wire organizer according to claim 1, wherein the plurality of wire receiving channels are arranged in a plurality of rows around a periphery of the wire comb.

* * * * *